US008715030B2

(12) United States Patent
Chin

(10) Patent No.: US 8,715,030 B2
(45) Date of Patent: May 6, 2014

(54) TOY BUILDING BLOCK

(76) Inventor: Hsiao-Chieh Chin, Taipei (TW)

( * ) Notice: Subject to any disclaimer, the term of this patent is extended or adjusted under 35 U.S.C. 154(b) by 214 days.

(21) Appl. No.: 13/334,570

(22) Filed: Dec. 22, 2011

(65) Prior Publication Data

US 2013/0165013 A1 Jun. 27, 2013

(51) Int. Cl.
*A63F 3/00* (2006.01)

(52) U.S. Cl.
USPC ..... 446/128; 273/276; 273/288

(58) Field of Classification Search
USPC ..... 446/120, 122, 124, 127, 128; 273/276, 273/288; D21/471, 478, 479, 484, 485, 486
See application file for complete search history.

(56) References Cited

U.S. PATENT DOCUMENTS

| | | | | | |
|---|---|---|---|---|---|
| 3,148,477 | A | * | 9/1964 | Bjphirn et al. | 52/591.2 |
| 3,162,973 | A | * | 12/1964 | Christiansen | 446/128 |
| 3,513,588 | A | * | 5/1970 | Fischer | 446/127 |
| 3,867,784 | A | * | 2/1975 | Lange | 446/128 |
| D279,915 | S | * | 7/1985 | Arnau Pibet | D21/500 |
| 4,823,532 | A | * | 4/1989 | Westerburgen | 52/592.6 |
| 4,919,635 | A | * | 4/1990 | Bertrand | 446/128 |
| D352,743 | S | * | 11/1994 | Kushner et al. | D21/500 |
| D368,939 | S | * | 4/1996 | Frederiksen | D21/500 |
| 5,795,210 | A | * | 8/1998 | Kushner et al. | 446/128 |
| 2011/0021107 | A1 | * | 1/2011 | Nag | 446/91 |

* cited by examiner

*Primary Examiner* — Vishu K. Mendiratta
(74) *Attorney, Agent, or Firm* — C. G. Mersereau; Nikolai & Mersereau, P.A.

(57) ABSTRACT

The toy building block has a top board, four sideboards, an open bottom and four holding spaces. The top board includes multiple rectangular protrusions and each protrusion has four side surfaces, four recesses and four positioning posts. The recesses are formed respectively in the side surfaces of the protrusion. Each positioning post is formed between two adjacent recesses of two adjacent side surfaces of the protrusion. Each sideboard includes multiple ribs. Each holding space is formed between two adjacent ribs of two adjacent sideboards. To assemble the toy building blocks, the open bottom of one toy building block is used to cover the protrusions of another toy building block to make the holding spaces of the one toy building block hold the positioning posts of another toy building block. Thus, the toy building blocks are securely assembled against rotation relative to each other.

5 Claims, 11 Drawing Sheets

TOY BUILDING BLOCK

BACKGROUND OF THE INVENTION

1. Field of the Invention

The present invention relates to a toy building block, and more particularly to a toy building block that can be securely connected to another toy building block.

2. Description of the Prior Arts

Toy building blocks can be assembled in many ways to construct anything and anything constructed can then be taken apart. Toy building blocks are a benefit for children because they improve eye-hand coordination and encourage imagination.

With reference to FIGS. 6 and 7, a conventional toy building block 20 is a hollow rectangular structure and comprises a top board 21, four sideboards 22 and an open bottom 23. The top board 21 includes an outer surface, an inner surface, multiple cylindrical protrusions 211 and a tube 212. The protrusions 211 extend from the outer surface of the top board 21. The tube 212 extends from a center of the inner surface of the top board 21. Each sideboard 22 includes multiple ribs 221 extending from an inner surface thereof. With reference to FIG. 8, to assemble the toy building blocks 20,20A, the open bottom 23 of one toy building block 20 is used to cover the protrusions 211A of the other toy building block 20A to make the ribs 221 and tube 212 of the one toy building block 20 abut the protrusions 211A of the other toy building block 20A. Thus, the toy building blocks 20,20A are assembled. However, when the one toy building block 20 covers only one protrusion 211A of the other toy building block 20A, the two toy building blocks 20,20A rotate relative to each other, as indicated by the arrowheads shown in FIG. 8, so that the toy building blocks 20,20A cannot be securely assembled together.

With reference to FIGS. 9 and 10, another conventional toy building block 30 is a hollow rectangular structure and comprises a top board 31, four sideboards 32 and an open bottom 33. The top board 31 includes an outer surface, an inner surface, multiple cylindrical protrusions 311 and a reinforcing board 312. The protrusions 311 extend from the outer surface of the top board 31. The reinforcing board 312 extends from the inner surface of the top board 31 and includes multiple ribs 313 extending from two side surfaces thereof. Each sideboard 32 includes multiple ribs 321 extending from an inner surface thereof. With reference to FIG. 11, to assemble the toy building blocks 30,30A, the open bottom 33 of one toy building block 30 is used to cover the protrusions 311A of the other toy building block 30A to make the ribs 313,321 of the one toy building block 30 abut the protrusions 311A of the other toy building block 30A. Thus, the toy building blocks 30,30A are assembled. However, when the one toy building block 30 covers only one protrusion 311A of the other toy building block 30A, the two toy building blocks 30,30A also rotate relative to each other, as indicated by the arrowheads shown in FIG. 11, so that the toy building blocks 30,30A cannot be securely assembled together.

To overcome the shortcomings, the present invention provides a toy building block to mitigate or obviate the aforementioned problems.

SUMMARY OF THE INVENTION

The main object of the present invention is to provide a toy building block that can be securely connected to another toy building block.

To achieve the foregoing objective, the toy building block in accordance with the present invention is a hollow rectangular structure and comprises a top board, four sideboards, an open bottom and four holding spaces. The top board includes multiple rectangular protrusions extending from an outer surface thereof. Each protrusion has four side surfaces, four recesses and four positioning posts. The recesses are formed respectively in the side surfaces of the protrusion. Each positioning post is formed between two adjacent recesses of two adjacent side surfaces of the protrusion. Each sideboard includes multiple ribs extending from an inner surface thereof. Each holding space is formed between two adjacent ribs of two adjacent sideboards and corresponds to a size of the positioning post of the protrusion. To assemble the toy building blocks, the open bottom of one toy building block is used to cover the protrusions of another toy building block to make the holding spaces of the one toy building block hold the positioning posts of another toy building block and to make the ribs of the one toy building block abut surfaces of the recesses of another toy building block. Thus, the toy building blocks are securely assembled against rotation relative to each other.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
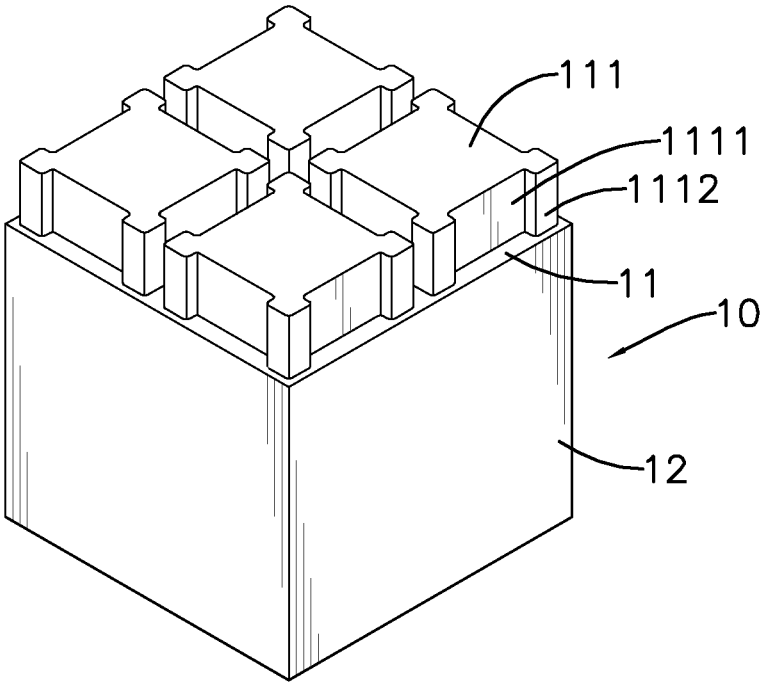
FIG. 1 is a top perspective view of a toy building block in accordance with the present invention.
Figure 2:
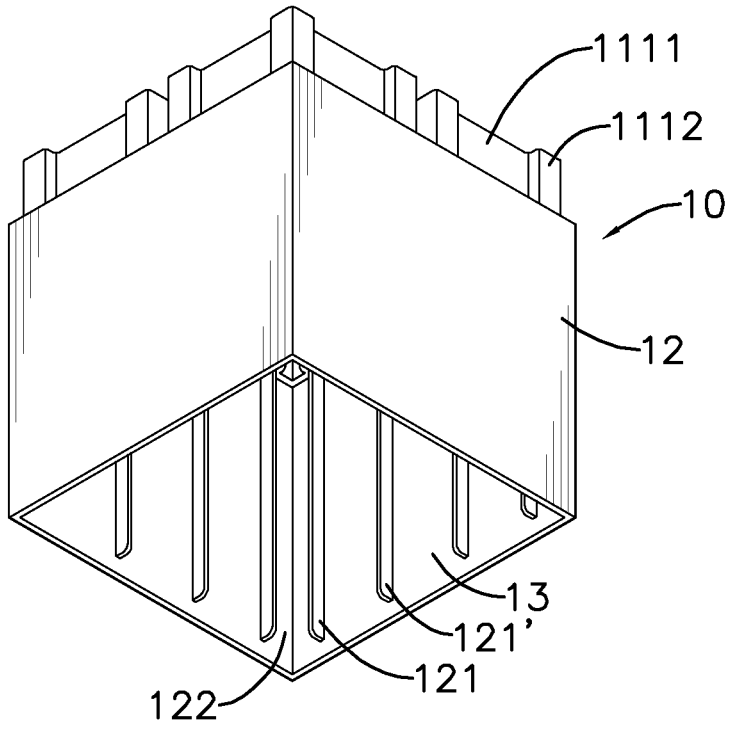
FIG. 2 is a bottom perspective view of the toy building block in FIG. 1.

With reference to FIGS. 1 and 2, a toy building block 10 in accordance with the present invention is a hollow rectangular structure and comprises a top board 11, four sideboards 12, an open bottom 13 and four holding spaces 122. The top board 11 includes multiple rectangular protrusions 111 extending from an outer surface thereof. Each protrusion 111 has four side surfaces, four recesses 1111 and four positioning posts 1112. The recesses 1111 are formed respectively in the side surfaces of the protrusion 111. Each positioning post 1112 is formed between two adjacent recesses 1111 of two adjacent side surfaces of the protrusion 111. That is, the positioning posts 1112 are disposed at four side corners of the protrusion 111. Each sideboard 12 includes multiple pairs of longitudinal ribs 121, 121' extending from an inner surface thereof. A space between the ribs 121, 121' of each pair corresponds to a transverse width of the recess 1111 of the protrusion 111. Each holding space 122 is formed between two adjacent ribs 121 of two adjacent sideboards 12 and corresponds to a size of the positioning post 1112 of the protrusion 111. That is, the holding spaces 122 are formed at four side corners within the toy building block 10.

Figure 3:
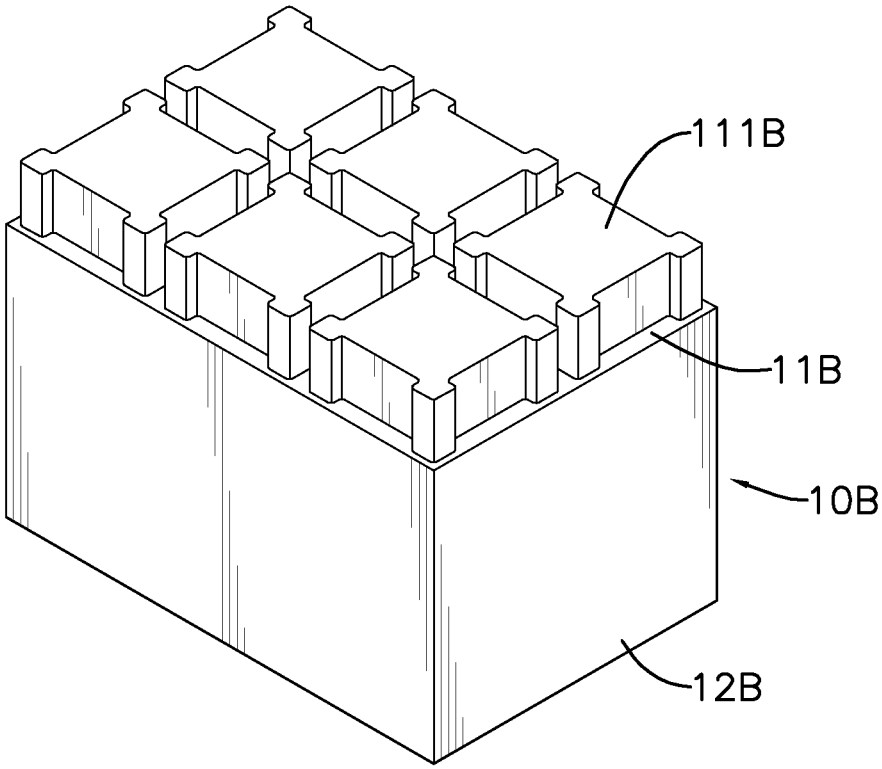
FIG. 3 is a top perspective view of another embodiment of a toy building block in accordance with the present invention.
Figure 4:
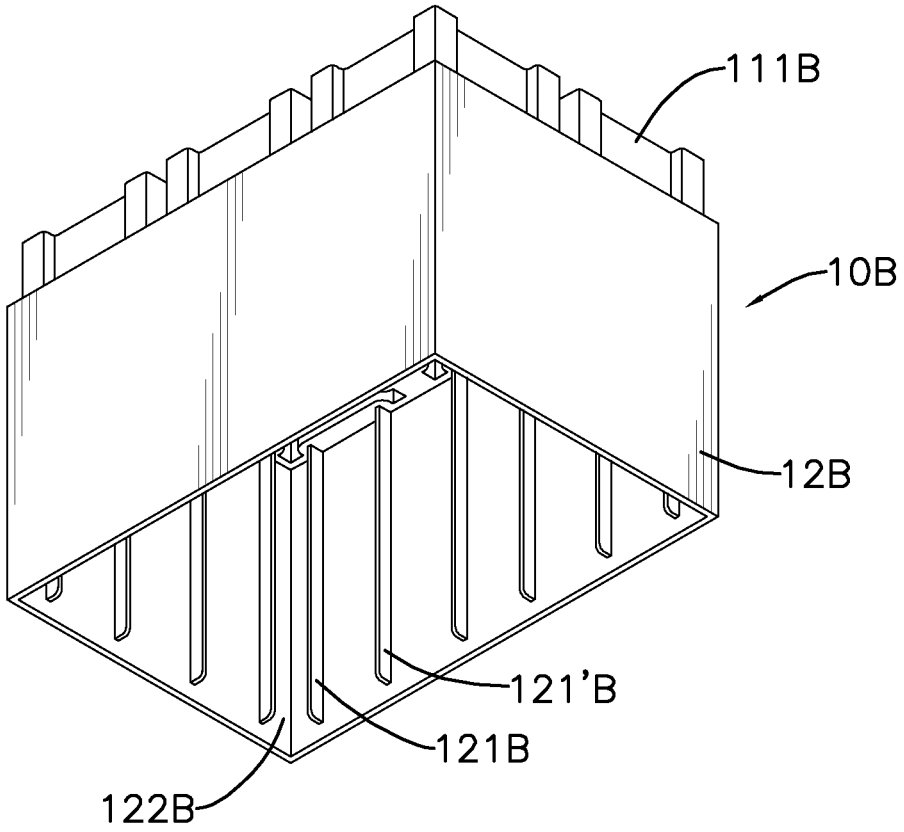
FIG. 4 is a bottom perspective view of the toy building block in FIG. 3.

In an embodiment, the toy building block 10 is a hollow square structure. The top board 11 includes four rectangular protrusions 111 arranged in two rows and two columns. Each sideboard 12 includes two pairs of the ribs 121, 121'. Each holding space 122 is formed between two adjacent ribs 121 of two adjacent sideboards 12. With reference to FIGS. 3 and 4, in another embodiment, the toy building block 10B is a hollow elongated rectangular structure and comprises two short sideboards 12B and two long sideboards 12B. The top board 11B includes six rectangular protrusions 111B arranged in three rows and two columns. Each short sideboard 12B includes two pairs of the ribs 121B, 121'B and each long sideboard 12B includes three pairs of the ribs 121B, 121'B. Each holding space 122B is formed between two adjacent ribs 121B of two adjacent sideboards 12B.

Figure 5:
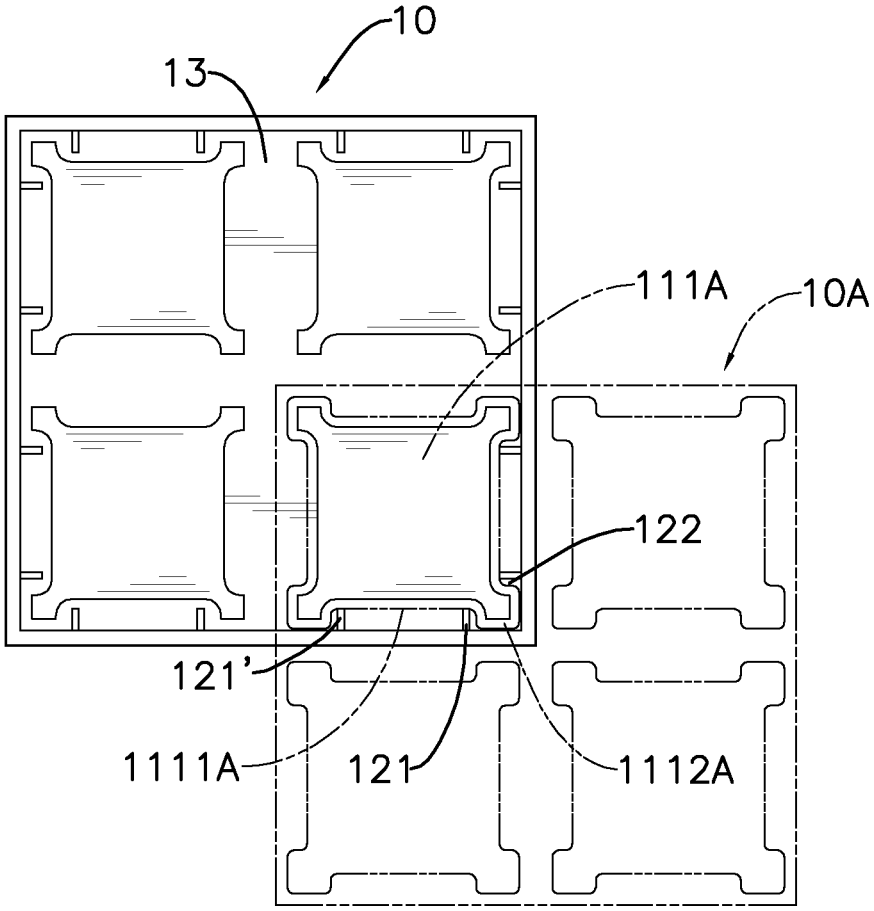
FIG. 5 is an operational bottom view of the toy building block in FIG. 1 showing that the toy building blocks are assembled.
Figure 6:
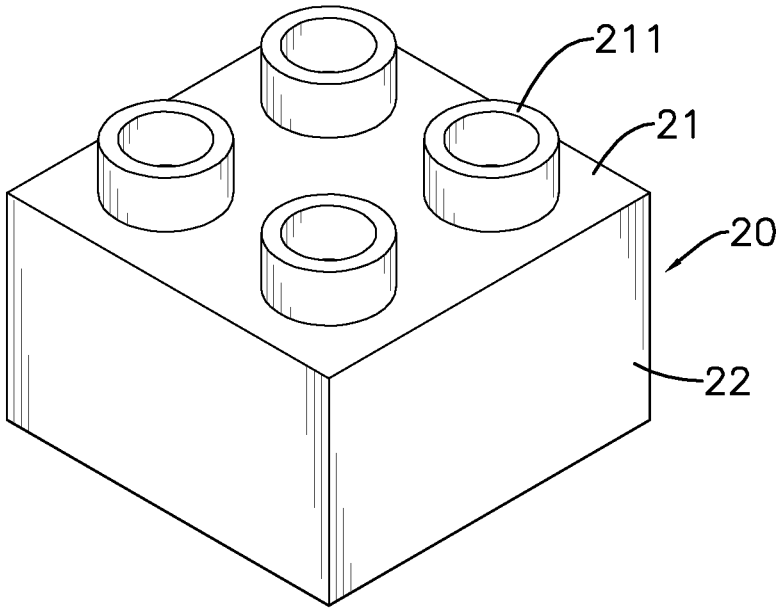
FIG.6 PRIOR ART
FIG. 6 is a top perspective view of a conventional toy building block in accordance with the prior art.
Figure 7:
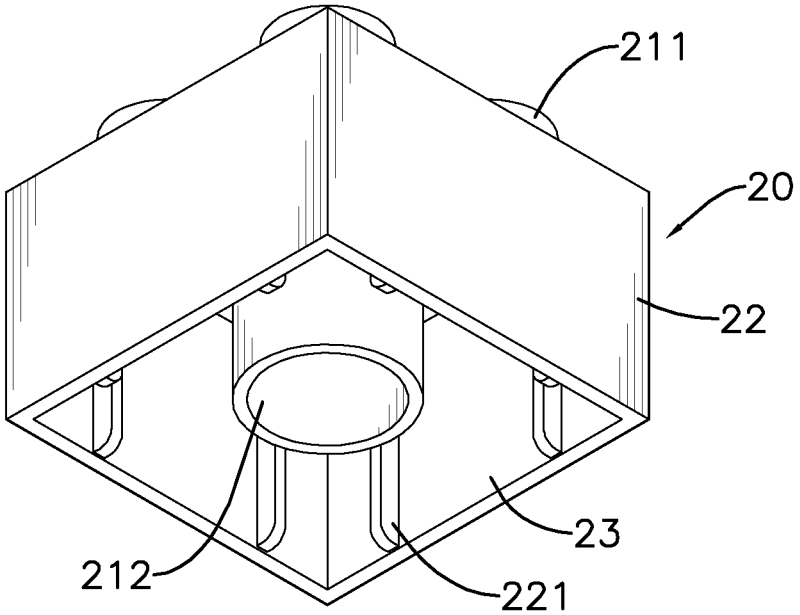
FIG.7 PRIOR ART
FIG. 7 is a bottom perspective view of the conventional toy building block in FIG. 6.
Figure 8:
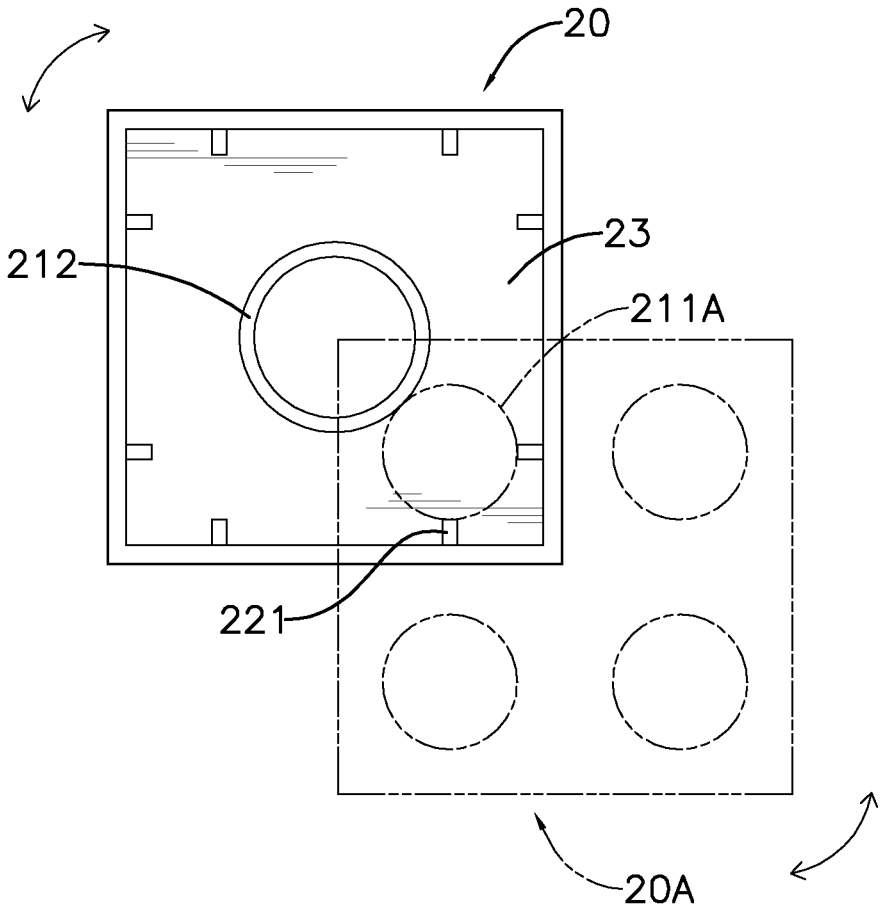
FIG.8 PRIOR ART
FIG. 8 is an operational bottom view of the conventional toy building block in FIG. 6 showing that the toy building blocks are assembled.
Figure 9:
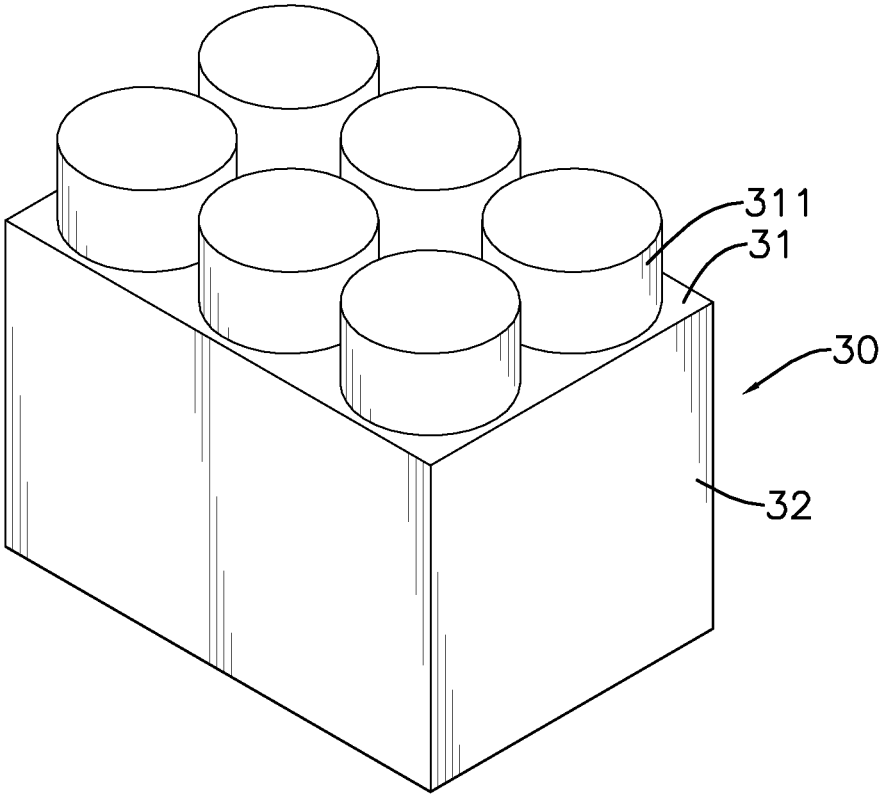
FIG.9 PRIOR ART
FIG. 9 is a top perspective view of another conventional toy building block in accordance with the prior art.
Figure 10:
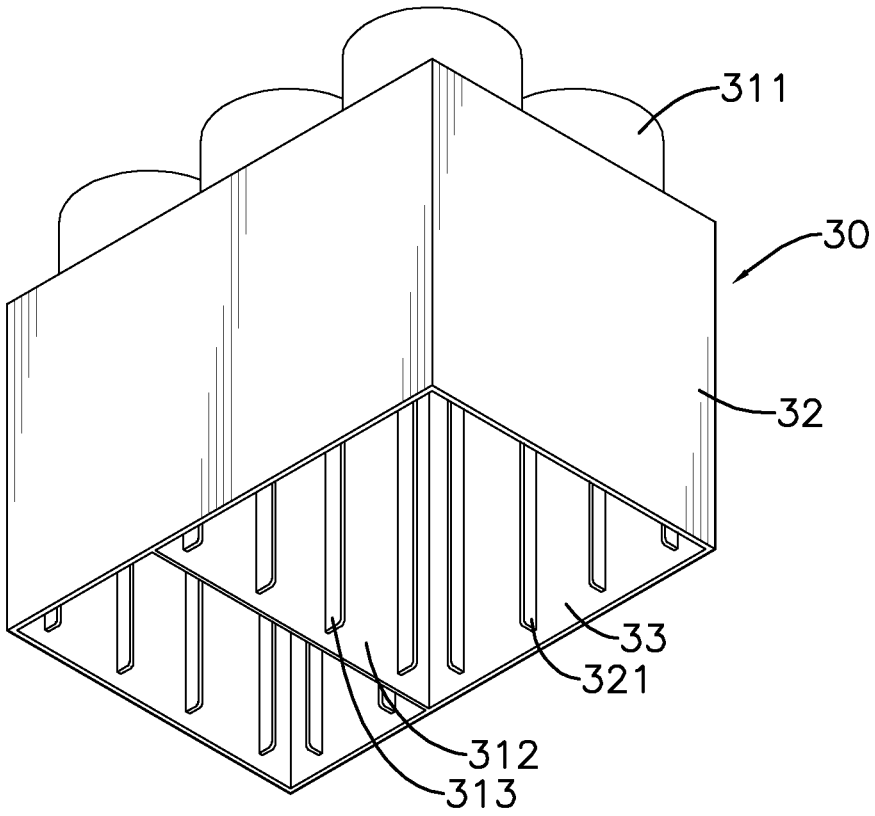
FIG. 10 PRIOR ART
FIG. 10 is a bottom perspective view of the conventional toy building block in FIG. 9.
Figure 11:
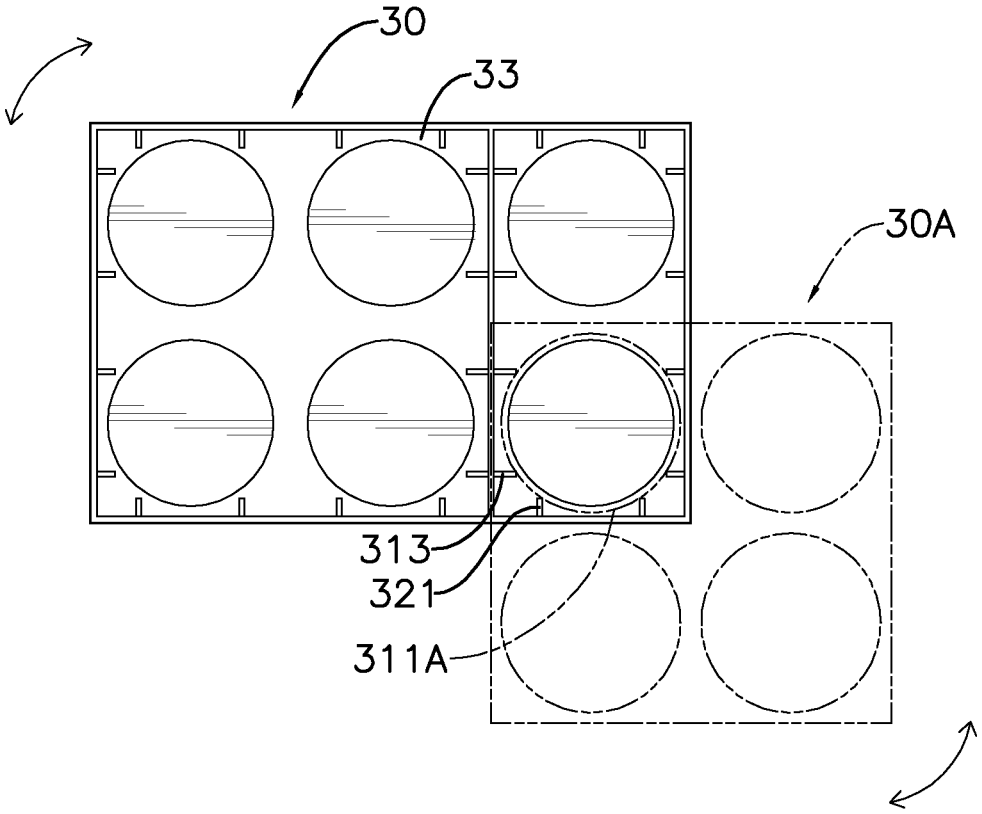
FIG. 11 PRIOR ART
FIG. 11 is an operational bottom view of the conventional toy building block in FIG. 9 showing that the toy building blocks are assembled.

With reference to FIG. 5, to assemble the toy building blocks 10, 10A, the open bottom 13 of one toy building block 10 is used to cover the protrusions 111A of the other toy building block 10A to make the holding spaces 122 of the one toy building block 10 hold the positioning posts 1112A of the other toy building block 10A and to make the ribs 121, 121' of the one toy building block 10 abut surfaces of the recesses 1111A of the other toy building block 10A. Thus, the toy building blocks 10, 10A are securely assembled and do not rotate relative to each other even if the one toy building block 10 covers only one protrusion 111A of the other toy building block 10A. Besides, the toy building block 10 of the present invention reduces the material cost for production as compared to the conventional toy building block because no tubes or reinforcing board on the top board 11 is required.

Even though numerous characteristics and advantages of the present invention have been set forth in the foregoing description, together with details of the structure and features of the invention, the disclosure is illustrative only. Changes may be made in the details, especially in matters of shape, size and arrangement of parts within the principles of the invention to the full extent indicated by the broad general meaning of the terms in which the appended claims are expressed.

What is claimed is:

1. A toy building block being a hollow rectangular structure and comprising:

a top board including multiple rectangular protrusions extending from an outer surface thereof and each protrusion having four side surfaces;

four recesses formed respectively in the side surfaces of the protrusion; and four positioning posts and each positioning post formed between two adjacent recesses of two adjacent side surfaces of the protrusion;

four sideboards and each sideboard including multiple ribs extending from an inner surface thereof;

an open bottom; and four holding spaces and each holding space formed between two adjacent ribs of two adjacent sideboards and corresponding to a size of the positioning post of the protrusion;

wherein each sideboard has multiple pairs of the ribs and a space between the ribs of each pair corresponds to a width of the recess of the protrusion so that when one protrusion of another toy building block engages the open bottom of the toy building block, two pairs of the ribs on two adjacent sideboards of the toy building block respectively engage two of the recesses of the protrusion of the another toy building block to make the two toy building blocks unrotatably engaged.

2. The toy building block as claimed in claim 1 being a hollow square structure and the top board including four rectangular protrusions.

3. The toy building block as claimed in claim 2, wherein the protrusions are arranged in two rows and two columns; and each sideboard includes two pairs of the ribs.

4. The toy building block as claimed in claim 1 being a hollow elongated rectangular structure and the top board including six rectangular protrusions.

5. The toy building block as claimed in claim 4, wherein the protrusions are arranged in three rows and two columns; and the toy building block comprises two short sideboards and each short sideboard including two pairs of the ribs; and two long sideboards and each long sideboard including three pairs of the ribs.

* * * * *